United States Patent [19]

Krnan

[11] Patent Number: 4,875,546

[45] Date of Patent: Oct. 24, 1989

[54] LOUDSPEAKER WITH ACOUSTIC BAND-PASS FILTER

[75] Inventor: Palo Krnan, Somerville, Mass.

[73] Assignee: Teledyne Industries, Inc., Los Angeles, Calif.

[21] Appl. No.: 201,539

[22] Filed: Jun. 2, 1988

[51] Int. Cl.[4] ..... A05K 5/00

[52] U.S. Cl. ..... 181/160; 181/144; 181/148; 181/150; 181/154; 181/156; 181/163; 181/199; 381/154; 381/159; 381/90

[58] Field of Search ..... 181/144, 145, 148, 150, 181/154–156, 160, 199, 163; 381/89, 90, 154, 159

[56] References Cited

U.S. PATENT DOCUMENTS

| | | | |
|---|---|---|---|
| 2,689,016 | 9/1954 | Lang | 181/145 |
| 3,449,519 | 6/1969 | Mowry | 181/145 X |
| 4,083,426 | 4/1978 | Peugh | 181/156 |
| 4,142,603 | 3/1979 | Johnson | 181/148 |
| 4,410,064 | 10/1983 | Taddeo | 181/152 |
| 4,549,631 | 10/1985 | Bose | 181/155 |
| 4,616,731 | 10/1986 | Robinson | 181/148 |

FOREIGN PATENT DOCUMENTS

| | | | |
|---|---|---|---|
| 7004707 | 12/1971 | France . | |
| 2327697 | 5/1977 | France | 181/163 |

OTHER PUBLICATIONS

Audio Cyclopedia, "Loudspeaker, Enclosures, Headphones, and Hearing Aids", Howard W. Sons & Co., Inc., 1974, pp. 1101–1105.

*Primary Examiner*—B. R. Fuller

*Attorney, Agent, or Firm*—Schiller, Pandiscio & Kusmer

[57] ABSTRACT

A loudspeaker having means for acoustically impeding excursion of the transducer diaphragm and means for acoustically attenuating the output of acoustic vibrations of frequencies above a preselected frequency. The loudspeaker includes first and second subchambers separated by a dividing wall in which the transducer is mounted. A first port acoustically couples the first subchamber with the second subchamber and a second port acoustically couples the second subchamber with the outside environment surrounding the loudspeaker.

24 Claims, 2 Drawing Sheets

LOUDSPEAKER WITH ACOUSTIC BAND-PASS FILTER

BACKGROUND OF THE INVENTION

The present invention relates to loudspeakers, and more particularly to a loudspeaker designed to limit electro-acoustic transducer diaphragm excursion and to acoustically attenuate acoustic vibrations above a preselected frequency.

When a speaker is energized, its diaphragm reciprocates or vibrates at a frequency which varies with the signal input to the speaker. When an unmounted or unbaffled speaker is operated in a so-called "free air" mode, it exhibits large mechanical excursions as it approaches its resonant frequency. Significant acoustic distortion is often associated with this large mechanical excursion. This large mechanical motion continues to the resonant frequency and then falls off at higher frequencies. To control this motion and thereby reduce the distortion level of the speaker, it is customary to mount the speaker in some form of housing, so that the air in the housing will tend to control this motion.

In its simplest form this housing may be a closed box with the speaker mounted or suspended in an opening in one wall thereof. This construction causes the amplitude of an excursion to be lowered, and to occur at a different frequency, thus changing the resonant frequency of the speaker as compared to its "free air" mode of operation.

Another type of speaker housing is known as a bass reflex or ported enclosure. Typically this enclosure includes a hole or port in one of its walls, usually the wall or speaker panel upon which the speaker is mounted. The enclosure itself, as represented by the air therein, thus forms a resonator, and permits some of the air from within the enclosure to be driven or forced in and out of the port during vibration of the speaker diaphragm. Air can thus be considered to vibrate like a piston in the port, sometimes vibrating at the same frequency as the speaker diaphragm, and at times being out of phase with the diaphragm frequency. Ideally, however, the frequency of this air vibration is tuned to the resonant frequency of the speaker by proper sizing of the enclosure and the port. Loudspeakers of this bass reflex type are illustrated, for example, in U.S. Pat. Nos. 4,410,064 to Taddeo and 4,549,631 to Bose.

Bass reflex loudspeakers of the type disclosed in U.S. Pat. No. 4,549,631 to Bose, which utilize two subchambers having ports for directly acoustically coupling each of the respective subchambers with the exterior environment, tend to provide poor response for acoustic frequencies falling between the resonant frequencies of the two subchambers and their corresponding respective ports when the resonant frequencies of the two subchambers vary by more than a factor of 3 to 1. For instance, if the resonant frequency of the first subchamber and associated port is 50 Hz and the resonant frequency of the second subchamber and associated port is 250 Hz (a factor of 5 to 1), poor response is typically obtained for frequencies between these two frequencies, i.e. frequencies in the 100–200 Hz range.

Broadband loudspeaker systems often include separate loudspeakers for providing the low, midrange and high frequency components of the broadband acoustic signal. These separate loudspeakers are coupled together by a suitable crossover network for applying the appropriate frequency component of the electrical input drive signal to each of the loudspeakers. For maximum listening enjoyment, it is often desirable to limit the frequency passband of the acoustic output of each of the loudspeakers.

For instance, in broadband loudspeaker systems employing a subwoofer loudspeaker for generating the lowest frequency passband component of the broadband input signal, it has been accepted recently in loudspeaker design that localization can be inhibited, i.e. the placement of the subwoofer made unnoticeable, by restricting the subwoofer to operate up to a maximum frequency of about 150 Hz. Electrical filters have been used to restrict high frequency electrical drive signals from reaching the transducer of the subwoofer. Unfortunately, low frequency electrical drive signals, which are of course required to excite the transducer, can cause the transducer to generate higher frequency distortion products. Thus, electrical filtering of higher frequency electrical drive signals does not avoid the potential for localization.

Similarly, with separate loudspeakers for generating acoustic output signals corresponding to higher frequency bands of the electrical input signal, it is often desirable to limit the frequency of the acoustic output signals to a selected level. When such limitation is achieved by electrical filtering, distortion products can be generated in the same manner described above with respect to a subwoofer.

SUMMARY OF THE INVENTION

An object of the present invention is to provide a loudspeaker which includes means for attenuating diaphragm excursions so as to minimize distortion in the acoustic output of the loudspeaker.

Another object of the present invention is to provide an improved mechanically constructed, acoustic bandpass filter which avoids or substantially reduces the above-noted problems associated with using cross-over networks comprising electrical bandpass filters.

Still another object of the present invention is to provide a loudspeaker which includes means for acoustically attenuating the acoustic output of the loudspeaker above a selected frequency.

Yet another object of the present invention is to provide a two-chamber bass reflex type loudspeaker having good frequency response for the frequencies between the resonant frequency associated with one of the chambers and the resonant frequency associated with the other of the chambers when the resonant frequencies of the two chambers are separated by a factor of as much as 10 to 1.

These and other objects are achieved by a novel loudspeaker comprising an enclosure partitioned into first and second subchambers by a dividing wall. An electro-acoustic transducer is mounted in an opening in the dividing wall so that its rear surface communicates with the air enclosed in the first subchamber and its front surface communicates with the air enclosed in the second subchamber. The first subchamber is pneumatically and acoustically coupled with the second subchamber by a first port sized to enclose a first acoustic mass of air while one of subchambers, preferably the second subchamber, is pneumatically and acoustically coupled with the outside environment by a second port sized to enclose a second acoustic mass of air. By properly constructing the first and second subchambers and first and second ports the structure will operate as an acoustic bandpass filter in which high frequency distortion components such as those generated by diaphragm excursions of the transducer will be acoustically attenuated.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

DETAILED DESCRIPTION OF THE INVENTION

Figure 1:
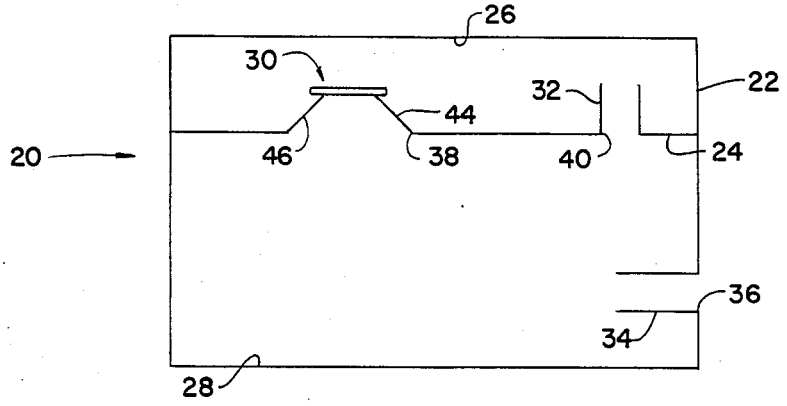
FIG. 1 is a schematic representation of the loudspeaker of the present invention.

The present invention is a loudspeaker in which distortion products in the acoustic output thereof are minimized by limiting transducer cone excursions and in which the production of acoustic output signals above a selected frequency is significantly attenuated without the use of electrical filters. In the most general sense, as illustrated in FIG. 1, the present invention is a loudspeaker 20 comprising a housing or enclosure 22 separated by dividing wall (or baffle) 24 into first subchamber 26 and second subchamber 28. The internal surfaces of both subchambers are substantially reflective to the acoustic energy generated by the electro-acoustic transducer 30 in response to an electrical input signal. The transducer is mounted in an opening in dividing wall 24. First subchamber 26 is coupled with second subchamber 28 via port 32, and second subchamber 28 is coupled with the outside atmosphere surrounding enclosure 22 via port 34.

To achieve the above-discussed attenuation in the high frequency distortion products and in the output acoustic frequencies above a preselected level, the volumes of subchambers 26 and 28 and ports 32 and 34 are selected based on the resonant frequency of electro-acoustic transducer 30 and the frequency above which acoustic output signals are to be attenuated. As discussed below, because an interrelationship exists between the characteristics of the subchambers, ports and other components of the loudspeaker, each component must be designed to properly interact with the other components.

Describing the present invention in greater detail, enclosure 22 encloses an interior air space which is shown in FIG. 1 as rectangular in cross-section, although other cross-sectional configurations may also be used. An aperture 36 is provided in one wall of enclosure 22 for coupling the interior thereof with the outside environment surrounding the enclosure. The interior of enclosure 22 is sealed, with respect to the acoustic energy generated by the transducer 30, from the outside environment, except via aperture 36.

The materials used in fabricating enclosure 22 and dividing wall 24 are selected so that subchambers 26 and 28 define acoustically reflective environments for the acoustic energy generated by the transducer 30. As discussed below, the size of each of the subchambers 26 and 28 is a function of the "cut off" frequency above which acoustic output signals of the loudspeaker are to be attenuated.

Dividing wall 24 comprises an opening 38 extending therethrough in which transducer 30 is mounted and an aperture 40 extending therethrough with which port 32 is coupled. Dividing wall 24 pneumatically seals first subchamber 26 from second subchamber 28 except via opening 38 and aperture 40.

Electro-acoustic transducer 30 comprises an energizing element and a vibrating diaphragm for converting an electrical input signal into an acoustic vibration output signal. As is well known, the energizing element may comprise a coil or other conductor of electricity in a magnetic or electric field or a piezo electric device. The diaphragm has a rear surface 44 and a front surface 46. When the transducer is energized, the diaphragm including its front and rear surfaces, vibrates at a frequency which varies with the input signal to the energizing element. As is well known, transducer 30 has at least one resonant frequency at which the diaphragm will exhibit large mechanical excursions. The specific resonant frequency at which such large mechanical excursions occur will of course depend upon the specific operational characteristics of the transducer employed.

Transducer 30 is mounted in opening 38 in dividing wall 24 so that rear surface 44 communicates with the air in first subchamber 26 and front surface 46 communicates with the air in second subchamber 28. Transducer 30 and opening 38 are sized so that the transducer will entirely fill the opening 38 so as to prevent the passage of air between subchambers 26 and 28 through opening 38.

Port 32 is an elongate hollow member open at both ends and sized to enclose a selected first acoustic mass of air. Preferably, although not necessarily, port 32 is tubular. Port 32 is attached to dividing wall 24 so as to be acoustically and pneumatically coupled with aperture 40 in the dividing wall and so that any air which passes between subchambers 26 and 28 must pass through port 32.

Figure 2:
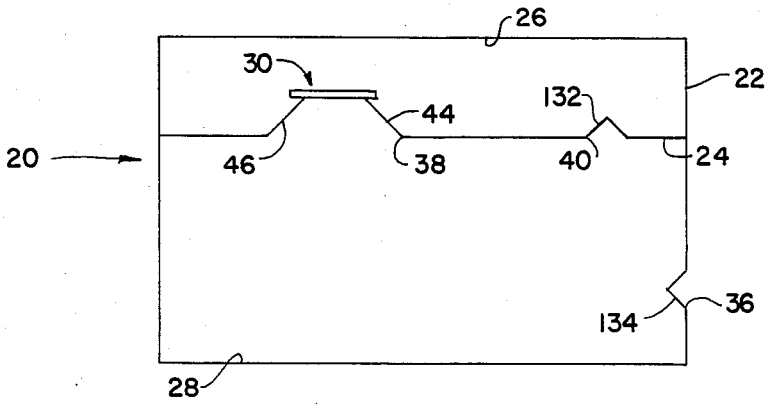
FIG. 2 is a schematic representation of another embodiment of the loudspeaker of the present invention in which drone cones are employed in place of port tubes.

Alternatively, as illustrated in FIG. 2, a conventional passive radiating element 132, such as a drone cone, may be used in place of port 32 for acoustically coupling first subchamber 26 with second subchamber 28. The passive radiating element 132 should be selected so that the mass of the element takes the place of the first acoustic mass of air enclosed by port 32.

Port 34 is an elongate hollow member open at both ends and sized to enclose a selected second acoustic mass of air. Preferably, but not necessarily, port 34 is tubular. Port 34 is attached to the wall of enclosure 22 in which aperture 36 is located so as to be acoustically and pneumatically coupled with aperture 36 and so that any air which passes between second subchamber 28 and the outside environment surrounding enclosure 22 must pass through port 34.

As with port 32, a passive radiating element 134 (see FIG. 2), such as a drone cone, may alternatively be employed in place of port 34 for acoustically coupling second subchamber 28 with the outside atmosphere surrounding enclosure 22. The passive radiating element should be selected so that the mass of the element takes the place of the second acoustic mass of air enclosed by port 34.

In accordance with well known acoustic theory used in the fabrication of bass reflex speakers of the type disclosed in U.S. Pat. No. 4,410,064, and as described in *Audio Cyclopedia,* 2 ed., Howard W. Sams & Co. Inc. (Indianapolis), 1974, p. 1101–1105, the size of subchamber 26 and port 32, and hence the volume of the air masses enclosed therein, are selected so that when the air in subchamber 26 is caused to vibrate acoustically by transducer 30, the air in subchamber 26 and the first acoustic mass of air enclosed in port 32 will resonant acoustically at a first resonant frequency which is "roughly" equal to, i.e. within approximately ±20% of, the resonant frequency of the transducer 30. The acoustic impedance associated with this acoustic resonance reduces the movement of the transducer diaphragm thereby reducing the mechanical overload and associated distortion that occurs at the resonant frequency of the transducer. Clearly, the resonant frequency of transducer 30 must be determined to properly select the sizes of subchamber 26 and port 32.

When a passive radiating element 132 such as a drone cone is used in place of port 32, the mass of the element is selected so that the latter will resonate with the air enclosed in the first subchamber 26 at the first resonant frequency. Thus, the mass of the passive radiating element 132 takes the place of the first acoustic mass of air.

The size of subchamber 28 and the internal dimensions of port 34, and hence the volume of the air masses enclosed therein, are selected so that acoustically vibrating air in subchamber 28 will resonate acoustically with the second acoustic mass of air enclosed in port 34 at a second resonant frequency. This selection of sizes and dimensions of the subchamber 28 and port 34 is made in the same manner used in selecting the sizes and dimensions of first subchamber 26 and first port 32. The second resonant frequency corresponds to the frequency at which attenuation of the acoustic output signal of the loudspeaker begins. Thus, in selecting the size of subchamber 28 and the internal dimensions of port 34, a determination must be made as to where in the frequency spectrum of the acoustic output of the loudspeaker attenuation will begin.

When a passive radiating element 134 such as a drone cone is used in place of port 34, the mass of the element is selected so that the latter will resonate with the air enclosed in the second subchamber at the second resonant frequency. Thus, the mass of the passive radiating element 134 takes the place of the second acoustic mass of air.

An acoustic impedance is associated with the second acoustic mass of air vibrating in port 34 at the second resonant frequency. This acoustic impedance increases with frequency for frequencies above the second resonant frequency, much as the electrical impedance of an inductor increases with frequency. The acoustic impedance thus impedes acoustic vibrations above the second resonant frequency from passing through port 34 to the outside environment surrounding the loudspeaker so as to function as an upper "cut off" frequency of an acoustic bandpass filter. This acoustic impedance thus attenuates the output of acoustic vibrations from the loudspeaker above the second resonant frequency, with the amount of attenuation increasing with frequency.

Practically speaking, the volume of the second subchamber 28 and the second acoustic mass of air will vary with the value of the desired second resonant frequency above which acoustic output signals are to be attenuated. The amount of required acoustic mass decreases with increasing frequency. Thus, for instance, for a second resonant frequency of 100 Hz, the volume of the subchamber 28 and the second acoustic mass will be larger than if the desired second resonant frequency is 1500 Hz.

In addition to the requirement of sizing each of the subchambers and its associated port in the manner discussed above, it is also preferred that a relationship exist between the sizes of the first and second subchambers. Specifically, the volume of the second subchamber 28 should be related to the volume of the first subchamber 26 by a factor of from about 1:1 to 6:1, with the preferred ratio being about 2.5 to 1.

Loudspeaker 20 is believed to operate in the following manner. Responsive to a low frequency electrical input signal, the transducer diaphragm will vibrate so as to create low frequency acoustic vibration of the air in subchambers 26 and 28. These low frequency acoustic vibrations move freely through port 32 to subchamber 28 where they destructively interfere (i.e., add in antiphase). As a result, very little of this low frequency acoustic vibration is transmitted through port 34 to the outside environment.

As the frequency of the acoustic vibrations in the subchambers 26 and 28 increases up to or near the first resonant frequency, i.e. the resonant frequency of transducer 30, the acoustic vibrations in subchamber 26 are transmitted via port 32 into subchamber 28 where they add constructively and are transmitted to the outside environment via port 34. The acoustic impedance associated with the acoustic resonance between the air enclosed in subchamber 26 and the first acoustic mass enclosed in port 32 minimizes transducer diaphragm excursion. By minimizing diaphragm excursion, the acoustic distortion produced by the mechanical overloading of the transducer occurring at its resonant frequency is minimized.

As the frequency of the acoustic vibrations created in subchambers 26 and 28 by transducer 30 increases, the vibrations continue to add constructively in subchamber 28 and communicate via port 34 with the outside environment. Above the first resonant frequency, however, the contribution of acoustic vibrations from subchamber 26 to the total emitted acoustic vibration decreases.

As the frequency of the acoustic vibrations created by transducer 30 continues to increase, a point is reached where the air enclosed in subchamber 28 acoustically resonates with the second acoustic mass enclosed in tube 34. Above this second resonant frequency the acoustic vibrations in subchamber 28 no longer effectively vibrate the second acoustic air mass. Vibration above the second resonant frequency is restrained by the acoustic impedance associated with the vibration of the second acoustic mass of air in port 34. As a result, the transmission of the acoustic vibrations in subchamber 28 above the second resonant frequency to the outside environment is reduced. So that as mentioned above, the second resonant frequency functions as the upper "cut off" frequency of an acoustic band pass filter. Further attenuation in transmission occurs with increasing frequency above the second resonant frequency at a rate of about 12 db of attenuation for each one octave increase in frequency.

When passive radiating elements 132 and 134 are used in place of ports 32 and 34, the loudspeaker functions in substantially the same manner described above. Thus, the air enclosed in first subchamber 26 resonates acoustically at the first resonant frequency with passive radiating element 132 used in place of port 32. Similarly, the air enclosed in second subchamber 28 resonates acoustically at the second resonate frequency with passive radiating element 134 used in place of port 34.

By limiting the transmission of higher frequency acoustic vibrations in this manner, the present invention achieves acoustic band-pass filtering. As such, the distortion products associated with electrical band-pass filtering are avoided.

By acoustically and pneumatically coupling first subchamber 26 with second subchamber 28 and the latter with the outside environment in the manner discussed above, good response is obtained for frequencies falling between the first resonant frequency and the second resonant frequency when the latter are separated by a factor of as much as 10 to 1. Preferably loudspeaker 20 is constructed so that the second resonant frequency is about 1.7 times as great as the first resonant frequency.

It is to be appreciated that the above-described embodiment of the present invention may be modified in a number of ways. First, a plurality of ports may be used for coupling subchamber 26 with subchamber 28 and for coupling subchamber 28 with the outside environment. The plurality of ports used in place of single port 32 should be sized so that the total volume of air enclosed in the ports will vibrate in resonance with the vibrating air enclosed in the subchamber 26 at the first resonant frequency. Similarly, the plurality of ports used in place of single port 34 should be sized so that the total volume of air enclosed in the ports will vibrate in resonance with the vibrating air enclosed in the subchamber 28 at the second resonant frequency. It may be desirable to use a plurality of ports in place of one port to achieve selected air flow characteristics for the air passing through the ports (e.g. to increase flow resistance) and/or where the physical configuration of the speaker enclosure is such that there is room for a plurality of small ports but not one large port. Similarly, a plurality of passive radiating elements maybe used in place of either or both passive radiating elements 132 and 134.

Second, dividing wall 24 may be inclined so as to form a non-orthogonal angle with respect to the sidewalls of enclosure 24. Angled placement of dividing wall 24 may serve to reduce or eliminate the formation of standing waves in the subchambers 26 and 28.

Third, two or more transducers may be supported in dividing wall 24. The transducers may be wired to reproduce the electrical input signal(s) carried on a single channel or on multiple different channels.

Figure 4:
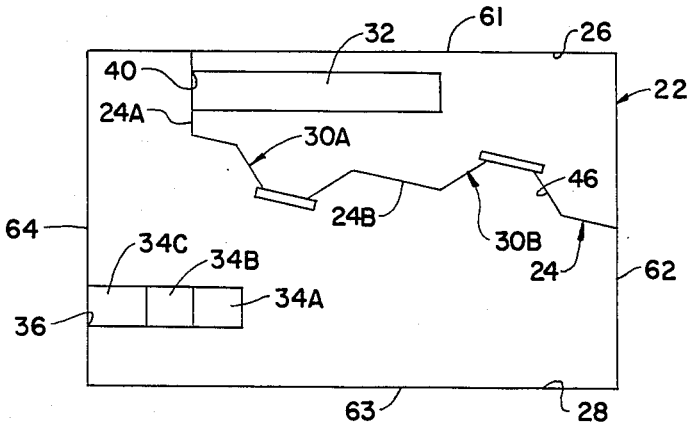
FIG. 4 is a plan view of the subwoofer taken along line 4—4 in FIG. 3.
Figure 3:
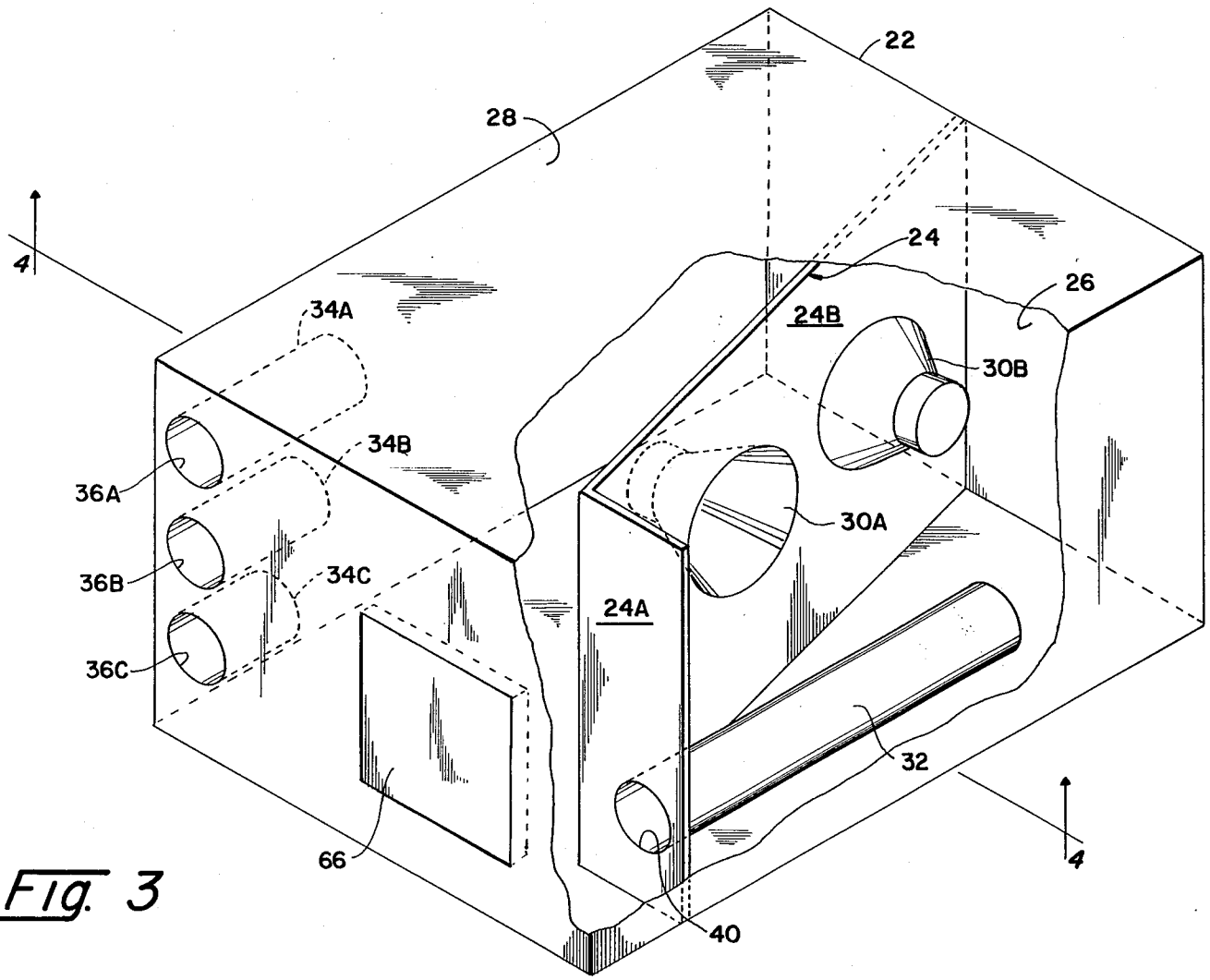
FIG. 3 is a perspective view of a subwoofer embodiment of the present invention.

Referring now to FIGS. 3 and 4, a specific embodiment of the present invention adapted to produce low frequency acoustic vibrations is illustrated. This embodiment, conventionally referred to in the art as a subwoofer, comprises a rectangular enclosure 22 having sidewalls 61–64 (see FIG. 4) and separated by dividing wall 24 into subchambers 26 and 28. Dividing wall 24 comprises a short section 24A which extends normally to the sidewall 61 to which the former is attached, and a long section 24B which extends at an angle to sidewall 62 to which the former is attached. Long section 24B is angled with respect to sidewall 62 to prevent the formation of standing waves. Subchamber 26 encloses about 370 cubic inches of air and subchamber 28 encloses about 930 cubic inches of air.

A pair of transducers 30A and 30B are mounted in dividing wall 24. Transducer 30A is mounted so that its front surface 46 is exposed to subchamber 26 and transducer 30B is mounted so that its front surface 46 is exposed to subchamber 28. Transducer 30A is coupled to one channel of the input signal and transducer 30B is coupled to the other channel of the input signal. Transducers 30A and 30B have a resonant frequency of about 60 Hz.

A single tubular port 32 mounted in short section 24A acoustically and pneumatically couples subchamber 26 with subchamber 28. Tubular port 32 is about 9 inches long and has an inside diameter of about 2 inches. A trio of tubular ports 34A, 34B and 34C mounted to sidewall 64 is provided for acoustically and pneumatically coupling subchamber 28 with the outside atmosphere. Tubular port 34A is about 2¾ inches long, tubular port 34B is about 2⅜ inches long, and tubular port 34C is about 2 inches long. All three of the ports have an inside diameter of about 2 inches.

A conventional cross-over network 66 is secured to the cabinet defining enclosure 22. Network 66 serves three well-known functions. First, network 66 prevents the low frequency drive signals intended for the subwoofer illustrated in FIGS. 3 and 4 from reaching loudspeakers provided for reproducing the mid and high frequency signals. Second, network 66 prevents the mid and high frequency drive signals intended for the mid and high frequency range loudspeakers from reaching the subwoofer. Third, network 66 provides proper electrical impedance as seen by the driving amplifier when the subwoofer is used with loudspeakers for reproducing the mid and high frequencies.

By forming subchamber 26 to enclose about 370 cubic inches of air and port 32 to enclose a first acoustic mass of air about 9 inches long and 2 inches in diameter, the air enclosed in subchamber 26 will resonate with the first acoustic mass of air at a first resonant frequency that is "roughly" equal to the resonate frequency of transducers 30A and 30B, i.e. 60 Hz ± about 20%.

By forming subchamber 28 to enclose about 930 cubic inches of air and ports 34A, 34B, and 34C to enclose a second acoustic mass of air about 2⅜ inches long and 3½ inches in diameter, the air enclosed in subchamber 28 will resonate with the second acoustic mass of air at a second resonant frequency of about 100 Hz. The volume of this second acoustic mass of air is about equal to a volume of air 7⅛ inches long (the combined length of the trio of ports) and 2 inches in diameter (the diameter of each of the trio of ports).

The subwoofer embodiment of the present invention illustrated in FIGS. 3 and 4 operates in the manner discussed above with respect to the generic embodiment of the present invention illustrated in FIG. 1. Thus, low frequency acoustic vibrations (i.e. below the first resonant frequency) produced by transducers 30A and 30B constructively interfere in subchamber 28 with the result that these low frequency vibrations below about 60 Hz do not effectively communicate via ports 34A, 34B and 34C with the outside environment. As the frequency of the acoustic vibrations increases to the first resonant frequency, the vibrations add constructively in subchamber 28 and are transmitted via ports 34A, 34B and 34C to the outside atmosphere. Around the first resonant frequency, 60 Hz, the acoustic impedance associated with the acoustic resonance between the air enclosed in subchamber 26 and the first acoustic mass of air enclosed in port 32 minimizes excursion of the diaphragms of transducers 30A and 30B. As the frequency of the acoustic vibrations in the subwoofer increase toward the second resonant frequency, 100 Hz, the acoustic vibrations in subchambers 26 and 28 continue to add constructively in subchamber 28 and are communicated via the second acoustic mass of air enclosed in ports 34A, 34B and 34C with the outside environment. When the frequency of the acoustic vibrations in subchambers 26 and 28 increases above the second resonant frequency, the acoustic vibrations can no longer effectively vibrate the second acoustic mass of air enclosed in ports 34A, 34B, and 34C. As a consequence, transmission of these higher frequency acoustic vibrations to the outside environment is attenuated at a rate of increase of about 12 db per octave. Thus, the subwoofer embodiment of the present invention illustrated in FIGS. 3 and 4 has a theoretical acoustic output cutoff frequency of about 100 Hz.

The present invention can be designed to reduce transducer diaphragm excursion and provide acoustic band pass filtering for a wide range of first resonant frequencies and second resonant frequencies, respectively, by suitably scaling up or down the volume of air enclosed by the subchambers 26 and 28 and the volume of the first and second acoustic masses of air enclosed, respectively, by ports 32 and 34. Thus, a wide range of transducers can be used in the present invention and acoustic output band-pass filtering can be achieved for a wide range of frequencies.

By constructing the loudspeaker of the present invention in the manner described above, good frequency response is obtained for frequencies between the first and second resonant frequencies when the latter are separated by a factor of up to about 10 to 1. This is highly advantageous inasmuch as the response of known dual-chamber bass reflex loudspeakers, such as the type described in U.S. Pat. No. 4,549,631, often falls off significantly when the first and second resonant frequencies are separated by more than a factor of 3 to 1.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. A loudspeaker comprising:

enclosure means for enclosing an acoustically-reflective chamber;

barrier means coupled to said enclosure means for dividing said chamber into first and second acoustically-reflective subchambers, said barrier means comprising an opening;

electro-acoustical transducer means, mounted relative to said opening, for causing air enclosed in said first and second subchambers to vibrate acoustically in response to an electrical input signal, said transducer means comprising a vibratable diaphragm;

first acoustic energy radiating means for enclosing a first acoustic mass of air acoustically coupling said first subchamber with said second subchamber;

second acoustic energy radiating means for enclosing a second acoustic mass of air acoustically coupling said second subchamber with an atmosphere outside said enclosure means;

said first subchamber and said first acoustic energy radiating means being configured so that air enclosed in said first subchamber resonates acoustically with said first acoustic mass of air at a first acoustic resonant frequency so as to provide a first acoustic impedance which impedes excursions of said diaphragm;

said second subchamber and said second acoustic energy radiating means being configured so that air enclosed in said second subchamber resonates acoustically with said second acoustic mass of air at a second resonant frequency so as to provide a second acoustic impedance which impedes transmission of acoustic vibrations of frequencies higher than said second resonant frequency from said second subchamber to said outside atmosphere through said second acoustic mass of air.

2. A loudspeaker according to claim 1, wherein said vibratable diaphragm resonates at a predetermined resonant frequency, and said first acoustic resonant frequency is roughly equal to said predetermined resonant frequency.

3. A loudspeaker according to claim 1, wherein said first and second acoustic energy radiation means and said first and second subchambers are configured so that said second resonant frequency ranges from one to ten times said first resonant frequency.

4. A loudspeaker according to claim 3, wherein said second resonant frequency is about 1.7 times said first resonant frequency.

5. A loudspeaker according to claim 1, wherein said first and second subchambers each enclose a volume of air and the volume of air enclosed by said second subchamber ranges from one to six times the volume of air enclosed by said first subchamber.

6. A loudspeaker according to claim 5, wherein the volume of air enclosed by said second subchamber is about 2.5 times the volume of air enclosed by said first subchamber.

7. A loudspeaker according to claim 1, wherein said first and second acoustic energy radiating means each comprise a tube open at both ends.

8. A loudspeaker according to claim 7, wherein said first and second energy radiating means each comprise a plurality of tubes, each of said tubes being open at both ends.

9. A loudspeaker according to claim 1, wherein said electro-acoustical transducer means comprises a plurality of electro-acoustical transducers, each of said plurality being mounted in said dividing wall.

10. A loudspeaker according to claim 9 wherein said input signal comprises signal energy, and wherein said loudspeaker further includes means for dividing the signal energy of said input signal into a frequency band having a plurality of different channels, wherein the signal energy within each of said channels is used to drive at least one of said plurality of electro-acoustical transducers.

11. A loudspeaker according to claim 1, wherein said enclosure means comprises a plurality of sidewalls and said barrier means comprises a planar surface extending at a noon-orthogonal angle to each of said plurality of sidewalls.

12. A loudspeaker according to claim 1, wherein said first and second acoustic energy radiating means each comprise at least one drone cone.

13. A loudspeaker comprising:

enclosure means for enclosing a volume of air;

electro-acoustical transducer means for causing air enclosed in said enclosure means to vibrate acoustically in response to an electrical input signal, said transducer means comprising a vibratable diaphragm having a resonant frequency;

means for transmitting acoustic vibrations from said enclosed air to an atmosphere outside said enclosure means;

first acoustic impedance means for impeding excursion of said diaphragm; and second acoustic impedance means for acoustically impeding transmission to said atmosphere, through said means for transmitting, of acoustic vibrations in said air enclosed in said enclosure means above a preselected frequency.

14. A loudspeaker according to claim 13, wherein said first acoustic impedance means comprises a first subchamber in said enclosure means for enclosing a first volume of air and first port means for enclosing a first acoustic mass of air, said first subchamber being positioned relative to said transducer means so that the transducer means can impart acoustic vibrations to said first volume of air, further wherein said first subchamber and said first port means are sized so that the volume of said first volume of air and the volume of said first acoustic mass of air such that said first volume of air and said first acoustic mass will resonate acoustically at a first resonant frequency roughly equal to said resonant frequency of said transducer diaphragm so as to generate a first acoustic impedance for impeding said excursion of said diaphragm.

15. A loudspeaker according to claim 13, wherein said means for transmitting encloses at least one acoustic mass of air and said second acoustic impedance means comprises at least one subchamber in said enclosure means for enclosing a volume of air, said at least one subchamber being positioned relative to said transducer means so that the transducer means can impart acoustic vibrations to said volume of air, said at least one subchamber being acoustically coupled to said means for transmitting, further wherein said at least one subchamber and said means for transmitting are sized so that said volume of air and the volume of said at least one acoustic mass of air are such that said volume of air and said at least one acoustic mass of air will vibrate acoustically at a resonant frequency so as to generate an acoustic impedance which impedes said transmission of acoustic vibrations of frequencies above said preselected frequency.

16. A loudspeaker according to claim 14, wherein said means for transmitting encloses a second acoustic mass of air and said second acoustic impedance means comprises a second subchamber in said enclosure means for enclosing a second volume of air, said second subchamber being positioned relative to said transducer means so that the transducer means can impart acoustic vibrations to said second volume of air, said second subchamber being acoustically coupled to said means for transmitting, further wherein said second subchamber and said means for transmitting are sized so that said second volume of air and the volume of said second acoustic mass of air are such that said second volume of air and said second acoustic mass of air will vibrate acoustically at a second resonant frequency so as to generate a second acoustic impedance which impedes said transmission of acoustic vibrations of frequencies above said preselected frequency.

17. A loudspeaker according to claim 15, wherein said first and second subchambers, said means for transmitting, and said first port means are configured so that said second resonant frequency is one to ten times greater than said first resonant frequency.

18. A loudspeaker according to claim 16, wherein said first and second subchambers are sized so that said second volume of air is 1 to 6 times as large as said first volume of air.

19. A loudspeaker according to claim 16, wherein said means for transmitting comprises at least one tube open at both ends and coupled to said enclosure so as to pneumatically and acoustically couple said second volume of air with the outside atmosphere surrounding said enclosure, and said first port means comprises at least one tube open at both ends and coupled to said first and second subchambers so as to pneumatically and acoustically couple said first volume of air with said volume of air.

20. A loudspeaker according to claim 13, wherein said first acoustic impedance means comprises:

a first subchamber for enclosing a first volume of air;

first passive radiating means for resonating acoustically with said first volume of air at a first resonant frequency roughly equal to said resonant frequency of said transducer diaphragm so as to generate a first acoustic impedance which impedes said excursion of said diaphragm.

21. A loudspeaker according to claim 20, wherein said first passive radiating means comprises at least one drone cone.

22. A loudspeaker according to claim 13, wherein said second acoustic impedance means comprises a subchamber for enclosing a volume of air, and wherein said means for transmitting comprises passive radiating means for resonating acoustically with said volume of air at a resonant frequency so as to generate an acoustic impedance which impedes said transmission of acoustic vibrations of frequencies above said preselected frequency.

23. A loudspeaker according to claim 20 wherein said passive radiating means comprises at least one drone cone.

24. A loudspeaker comprising:

an enclosure for enclosing an acoustically-reflective chamber, said enclosure having four sidewalls and a trio of apertures extending through one of said sidewalls coupling said chamber with an outside atmosphere surrounding said enclosure;

a dividing wall for dividing said chamber into first and second acoustically-reflective subchambers, said dividing wall forming a non-orthogonal angle with at least one of said sidewalls, said dividing wall comprising an aperture and first and second openings extending therethrough, said dividing wall being positioned so that said first subchamber encloses a first volume of air and said second subchamber encloses a second volume of air, said second volume of air being about two and one-half times as large as said first volume of air;

first and second electro-acoustical transducers each for converting an electrical input signal into an acoustic output signal, said first transducer being mounted in said first opening and said second transducer being mounted in said second opening, said first and second transducers each having a resonant frequency of about 60 Hz;

a first tube open at both ends thereof and secured to said dividing wall so as to be acoustically and pneumatically coupled with said aperture extending through said dividing wall, said first tube enclosing a first acoustic mass of air;

a trio of tubes when enclosing a second acoustic mass of air, each of said tubes being open at both ends thereof and secured to said one sidewall so that each of said trio of tubes is acoustically and pneumatically coupled with a corresponding respective one of said trio of apertures in said sidewall whereby said second acoustic mass of air is coupled with said outside atmosphere;

said first subchamber and said first tube being sized so that the air enclosed in said first subchamber and said first acoustic mass of air will resonate acoustically at a first resonant frequency that is roughly equal to the resonant frequency of said first and second transducers so as to generate a first acoustic impedance which minimizes excursion of said diaphragm; and said second subchamber and said trio of tubes being sized so that the air enclosed in said second subchamber and said second acoustic mass of air will resonate acoustically at a second resonant frequency so as to generate a second acoustic impedance which impedes transmission of acoustic vibrations of frequencies higher than said second resonant frequency from said second subchamber to said outside atmosphere through said second acoustic mass of air.

* * * * *

UNITED STATES PATENT AND TRADEMARK OFFICE

CERTIFICATE OF CORRECTION

PATENT NO. : 4,875,546

DATED : October 24, 1989

INVENTOR(S) : Palo Krnan

It is certified that error appears in the above-identified patent and that said Letters Patent is hereby corrected as shown below:

Claim 11, column 10, line 59, delete "noon", and substitute therefor -- non --;

Claim 14, column 11, line 23, after "air" (first occurrence), insert -- are --;

Claim 17, column 11, line 66, delete "15" and substitute therefor -- 16 --;

Claim 19, column 12, line 15, after "said" (second occurrence), insert -- second --;

Claim 23, column 12, line 38, delete "20", and substitute therefor -- 22 --;

UNITED STATES PATENT AND TRADEMARK OFFICE

CERTIFICATE OF CORRECTION

PATENT NO. : 4,875,546

DATED : October 24, 1989

INVENTOR(S) : Palo Krnan

It is certified that error appears in the above-identified patent and that said Letters Patent is hereby corrected as shown below:

Claim 24, column 13, line 8, after "said" (second occurrence), insert -- one --.

Signed and Sealed this

Fifth Day of February, 1991

*Attest:*

HARRY F. MANBECK, JR.

*Attesting Officer*

*Commissioner of Patents and Trademarks*